US007934906B2

(12) United States Patent
Gu et al.

(10) Patent No.: US 7,934,906 B2
(45) Date of Patent: May 3, 2011

(54) TURBINE BLADE TIP COOLING SYSTEM

(75) Inventors: Xubin Gu, Orlando, FL (US); George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 777 days.

(21) Appl. No.: 11/939,592

(22) Filed: Nov. 14, 2007

(65) Prior Publication Data

US 2009/0123292 A1 May 14, 2009

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS

| | | | | |
|---|---|---|---|---|
| 4,111,596 | A | 9/1978 | Amana et al. | |
| 4,786,016 | A | 11/1988 | Presz, Jr. et al. | |
| 5,142,859 | A | 9/1992 | Glezer et al. | |
| 5,246,340 | A * | 9/1993 | Winstanley et al. | 416/97 R |
| 5,263,820 | A | 11/1993 | Tubbs | |
| 5,333,992 | A | 8/1994 | Kane et al. | |
| 5,564,902 | A * | 10/1996 | Tomita | 416/97 R |
| 5,758,487 | A | 6/1998 | Salt et al. | |
| 5,873,695 | A | 2/1999 | Takeishi et al. | |
| 6,164,913 | A | 12/2000 | Reddy | |
| 6,257,830 | B1 | 7/2001 | Matsuura et al. | |
| 6,325,593 | B1 | 12/2001 | Darkins, Jr. et al. | |
| 6,347,923 | B1 * | 2/2002 | Semmler et al. | 416/97 R |
| 6,428,273 | B1 | 8/2002 | Keith et al. | |
| 6,481,966 | B2 | 11/2002 | Beeck et al. | |
| 6,602,047 | B1 | 8/2003 | Barreto et al. | |
| 6,612,811 | B2 | 9/2003 | Morgan et al. | |
| 6,869,270 | B2 | 3/2005 | Bunker et al. | |
| 7,165,940 | B2 | 1/2007 | McGrath et al. | |
| 2006/0222497 | A1 | 10/2006 | Lee | |
| 2006/0269408 | A1 | 11/2006 | Liang | |
| 2006/0275118 | A1 | 12/2006 | Lee | |
| 2007/0048135 | A1 | 3/2007 | Pietraszkiewicz et al. | |
| 2007/0071601 | A1 | 3/2007 | Papple | |

FOREIGN PATENT DOCUMENTS

| | | | |
|---|---|---|---|
| EP | 0034961 | A1 | 9/1981 |
| EP | 0939196 | A2 | 9/1999 |
| EP | 1126135 | A2 | 8/2001 |
| EP | 1321628 | A2 | 6/2003 |
| JP | 05156901 | A | 6/1993 |
| JP | 2006083851 | A | 3/2006 |
| RU | 2208683 | C1 | 7/2003 |

* cited by examiner

*Primary Examiner* — Richard Edgar

(57) ABSTRACT

A turbine blade for a turbine engine having a cooling system in the turbine blade formed from at least one elongated tip cooling chamber forming a portion of the cooling system and at least partially defined by the tip wall proximate to the first end. An inner surface of the tip wall may include a plurality of curved bumper protrusions extending from the inner surface radially inward toward the root. The cooling system may include a plurality of ribs generally aligned with the trailing edge, and the curved bumper protrusions may be offset in a chordwise direction relative to the ribs. A throat section may extend between a first forwardmost curved bumper protrusion and a second immediately adjacent downstream curved bumper protrusion and may be offset radially outward from an inner tip surface, thereby creating a first recessed tip slot with a reduced tip wall thickness.

19 Claims, 2 Drawing Sheets

TURBINE BLADE TIP COOLING SYSTEM

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Often times, localized hot spots form in the tip section of turbine blades. Thus, a need exists for removing excessive heat in the tip section of turbine blades.

SUMMARY OF THE INVENTION

This invention relates to a turbine blade cooling system for turbine blades used in turbine engines. In particular, the turbine blade cooling system includes a cavity positioned between two or more walls forming a housing of the turbine blade. The cooling system may include at least one elongated tip cooling chamber forming a portion of the cooling system and at least partially defined by a tip wall proximate to the first end. An inner surface of the tip wall may include a plurality of curved bumper protrusions extending from the inner surface radially inward toward the root. Recessed tip slots may be positioned between the protrusions, which reduces the thickness of the outer wall at the first end, thereby making it easier to cool the tip of the blade.

The turbine blade may be formed from a generally elongated blade having a leading edge, a trailing edge, a tip wall at a first end, a root coupled to the blade at an end generally opposite the first end for supporting the blade and for coupling the blade to a disc, and at least one cavity forming a cooling system in the blade. At least one elongated tip cooling chamber may form a portion of the cooling system and at least partially defined by the tip wall proximate to the first end. An inner surface of the tip wall may include a plurality of curved bumper protrusions extending from the inner surface radially inward toward the root. A plurality of ribs may be generally aligned with the trailing edge, and the curved bumper protrusions extending radially inward from the inner surface of the tip wall may be offset in a chordwise direction relative to the ribs.

A throat section extending between a first forwardmost curved bumper protrusion and a second immediately adjacent downstream curved bumper protrusion may be offset radially outward from an inner tip surface, thereby creating a first recessed tip slot having a reduced tip wall thickness. The first recessed tip slot is positioned proximate to a row of ribs. A throat section extending between the second curved bumper protrusion and a third immediately adjacent downstream curved bumper protrusion may be offset radially outward from an inner tip surface, thereby creating a second recessed tip slot having a reduced tip wall thickness. The first recessed tip slot may be positioned proximate to a row of ribs, and the second recessed tip slot may be positioned proximate to another row of ribs.

The turbine blade may also include a rib extending radially from an outer surface of the tip of the generally elongated blade and at a perimeter of the blade such that a pocket is formed within the rib on the outer surface of the tip wall of the generally elongated blade. The rib extending radially from an outer surface of the tip of the generally elongated blade may be discontinuous such that a portion of the rib on a pressure side terminates upstream from the trailing edge while a portion of the rib on a suction side terminates at the trailing edge, thereby forming a pressure side slot in the pocket on the outer surface of the tip wall of the generally elongated blade.

An advantage of this invention is that the multiple curved bumper protrusions can induce cooling fluid flow impingement and reattachment, and thus enhance the internal cooling heat transfer coefficient (HTC).

Another advantage of this invention is that the multiple curved bumper protrusions can create additional flow resistance on cooling fluid flow through the tip channel, which can make the cooling flow in the trailing edge more uniform.

Yet another advantage of this invention is that the multiple curved bumper protrusions can create leading faces that create higher driving pressure in the cooling fluid flow past the multiple curved bumper protrusions. The higher driving pressure can provide higher back flow margin when implementing inclined dust cooling holes in the pocket at the trailing edge.

Another advantage of this invention is that the recess tip slots reduce the tip wall thickness in a region of the tip wall that is prone to an extremely high thermal gradient. As such, the recess tip slots greatly enhance the local conductive heat transfer. Combined with the enhanced internal convective cooling induced by the multiple curved bumper protrusions, this cooling arrangement can effectively reduce surface temperatures of the blade at the trailing edge.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
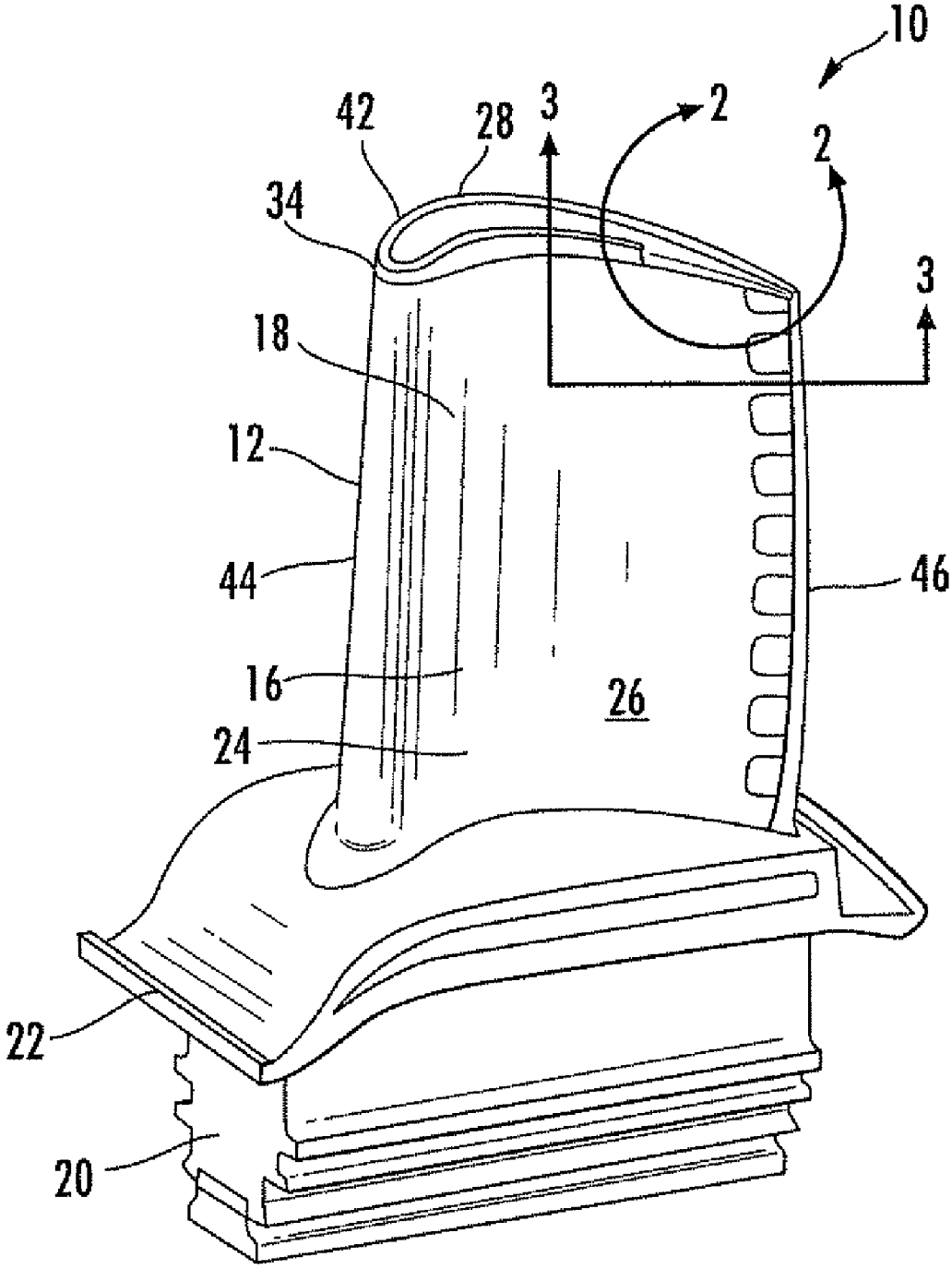
FIG. 1 is a perspective view of a turbine blade having features according to the instant invention.
Figure 2:
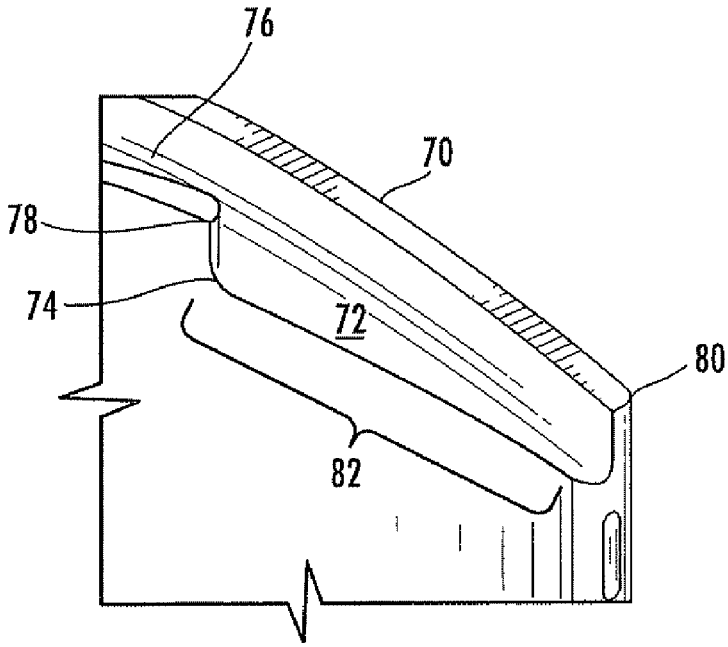
FIG. 2 is detailed perspective view of a portion of the tip of the turbine blade shown in FIG. 1 taken along line 2-2.
Figure 3:
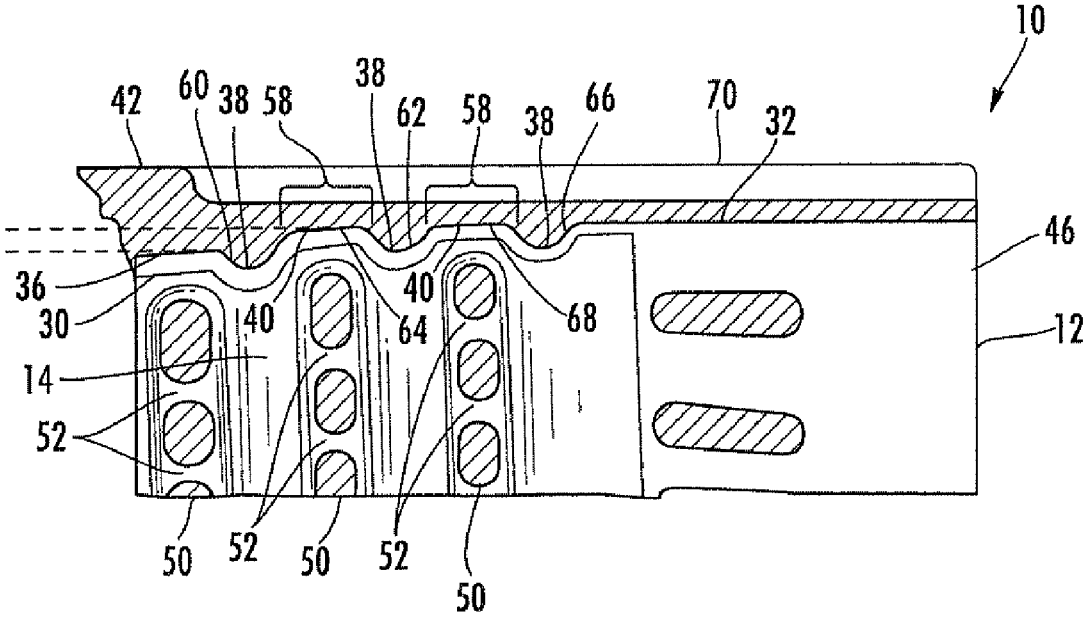
FIG. 3 is a partial cross-sectional view of the turbine blade shown in FIG. 1 taken along line 3-3.

As shown in FIGS. 1-3, this invention is directed to a turbine blade cooling system 10 for turbine blades 12 used in turbine engines. In particular, the turbine blade cooling system 10 includes a cavity 14, as shown in FIGS. 2 and 3, positioned between two or more walls forming a housing 16 of the turbine blade 12. The cooling system 10 may include at least one elongated tip cooling chamber 30 forming a portion of the cooling system 10 and at least partially defined by a tip wall 32 proximate to the first end 34. An inner surface 36 of the tip wall 32 may include a plurality of curved bumper protrusions 38 extending from the inner surface 36 radially inward toward the root 20. Recessed tip slots 40 may be positioned between the protrusions 38, which reduces the thickness of the outer wall 24 at the first end 34, thereby making it easier to cool the tip 42 of the blade 12.

As shown in FIG. 1, the turbine blade 12 may be formed from a generally elongated blade 18 coupled to the root 20 at the platform 22. Blade 18 may have an outer wall 24 adapted for use, for example, in a first stage of an axial flow turbine engine. Outer wall 24 may form a generally concave shaped portion forming pressure side 26 and may have a generally convex shaped portion forming suction side 28. The generally elongated blade 18 may have a leading edge 44 and a trailing edge 46. The cavity 14, as shown in FIG. 2, may be positioned in inner aspects of the blade 18 for directing one or more gases, which may include air received from a compressor (not shown), through the blade 18 to reduce the temperature of the blade root 20. The cavity 14 may be arranged in various configurations and is not limited to a particular flow path.

The turbine blade cooling system 10 may include one or more rows of ribs 50 that extend proximate to the trailing edge 46. In one embodiment, the rows of ribs 50 may be generally aligned with the trailing edge 46. The ribs 50 may include a plurality of orifices 52 that may aligned or offset to orifices in ribs 50 upstream and downstream. The ribs 50 may extend from the root 20 and may terminate in close proximity to the inner surface 36 of the tip wall 32. However, the ribs 50 may not contact the inner surface 36 of the tip wall 32, but rather terminate short of the tip wall 32, thereby creating a tip channel 30 between the ribs 50 and the tip wall 32.

The tip wall 32 may include curved bumper protrusions 38 extending radially inward from the inner surface of the tip wall 32. The curved bumper protrusions 38 may extend a distance radially inward from the tip wall 32 up to the distance between the ribs 50 and the inner surface 36 of the tip wall 32. The curved bumper protrusions 38 may be offset in the chordwise direction from the ribs 50. The curved bumper protrusions 38 may be separated by recessed tip slots 40. The recessed tip slots 40 may be formed from portions of the tip wall 32 between the curved bumper protrusions 38 that are offset radially outward from the inner surface 36 of the tip wall 32. Such a configuration reduces the thickness of the tip wall 32 at the trailing edge 46 and at the region proximate to the trailing edge 46, thereby facilitating easier cooling.

In one embodiment, a throat section 58 may extend between a first forwardmost curved bumper protrusion 60 and a second immediately adjacent downstream curved bumper protrusion 62 and may be offset radially outward from the inner surface 36, thereby creating a first recessed tip slot 64 with reduced outer wall 32 thickness. The first recessed tip slot 64 may be positioned proximate to the rib 50. The tip wall 32 may also include a throat section 58 extending between the second curved bumper protrusion 62 and a third immediately adjacent downstream curved bumper protrusion 66 and may be offset radially outward from the inner surface 36, thereby creating a second recessed tip slot 68 with reduced outer wall 32 thickness. The curved bumper protrusions 38 may be identically shaped and sized. In other embodiments, the curved bumper protrusions 38 may be differently shaped or differently sized, or both. The curved bumper protrusions 38 may extend from the pressure side 26 to the suction side 28.

The turbine blade 12 may also include a rib 70 extending radially from an outer surface 72 of the tip 42 of the generally elongated blade 18 and at a perimeter 74 of the blade 12 such that a pocket 76 is formed within the rib 70 on the outer surface 72 of the tip wall 32 of the generally elongated blade 18. The rib 70 extending radially from an outer surface 72 of the tip 42 of the generally elongated blade 18 may be discontinuous such that a portion 78 of the rib 70 on the pressure side 26 terminates upstream from the trailing edge 46 while a portion 80 of the rib 70 on the suction side 28 terminates at the trailing edge 46, thereby forming a pressure side slot 82 in the pocket 76 on the outer surface 72 of the tip wall 32 of the generally elongated blade 18. This pressure side slot 82 on blade tip permits cooled gas to roll up from pressure side 26 to tip 42 of the generally elongated blade 18 and directly cool the blade tip pocket 76 at trailing edge 46.

During operation, cooling fluids, which may be, but are not limited to, air, flow through into the cooling system 10 from the root 20. At least a portion of the cooling fluids flow into the cavity 14, and at least some of the cooling fluids flow into the tip channel 30. The cooling fluids can flow through the tip channel 30 and be exhausted through the trailing edge 46. The multiple curved bumper protrusions 38 improve the cooling efficiency of the turbine blade cooling system 10. The multiple curved bumper protrusions 38 can induce cooling fluid flow impingement and reattachment, and thus enhance the internal cooling heat transfer coefficient (HTC). The multiple curved bumper protrusions 38 can create additional flow resistance on cooling fluid flow through the tip channel 30, which can make the cooling flow in the trailing edge more uniform. The multiple curved bumper protrusions 38 can create leading faces that create higher driving pressure in the cooling fluid flow past the multiple curved bumper protrusions 38. The higher driving pressure can provide higher back flow margin when implementing inclined dust cooling holes in the pocket 76 at the trailing edge 46. The recess tip slots 40 reduce the top wall thickness in a region of the tip wall 42 that is prone to an extremely high thermal gradient. As such, the recess tip slots 40 greatly enhance the local conductive heat transfer. Combined with the enhanced internal convective cooling induced by the multiple curved bumper protrusions 38, this cooling arrangement can effectively reduce surface temperatures of the blade 12 at the trailing edge 46.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine blade, comprising:

a generally elongated blade having a leading edge, a trailing edge, a tip wall at a first end, a root coupled to the blade at an end generally opposite the first end for supporting the blade and for coupling the blade to a disc, and at least one cavity forming a cooling system in the blade;

at least one elongated tip cooling chamber forming a portion of the cooling system and at least partially defined by the tip wall proximate to the first end, wherein an inner surface of the tip wall includes a plurality of curved bumper protrusions extending from the inner surface radially inward toward the root; and wherein a throat section extending between a first forwardmost curved bumper protrusion and a second immediately adjacent downstream curved bumper protrusion is offset radially outward from an inner tip surface, thereby creating a first recessed tip slot having a reduced tip wall thickness.

2. The turbine blade of claim 1, wherein the cooling system includes a plurality of ribs generally aligned with the trailing edge and wherein the curved bumper protrusions extending radially inward from the inner surface of the tip wall are offset in a chordwise direction relative to the ribs.

3. The turbine blade of claim 1, wherein the first recessed tip slot is positioned proximate to a row of ribs.

4. The turbine blade of claim 1, further comprising a rib extending radially from an outer surface of the tip of the generally elongated blade and at a perimeter of the blade such that a pocket is formed within the rib on the outer surface of the tip wall of the generally elongated blade.

5. The turbine blade of claim 4, wherein the rib extending radially from an outer surface of the tip of the generally elongated blade is discontinuous such that a portion of the rib on a pressure side terminates upstream from the trailing edge while a portion of the rib on a suction side terminates at the trailing edge, thereby forming a pressure side slot in the pocket on the outer surface of the tip wall of the generally elongated blade.

6. The turbine blade of claim 1, wherein a throat section extending between the second curved bumper protrusion and a third immediately adjacent downstream curved bumper protrusion is offset radially outward from an inner tip surface, thereby creating a second recessed tip slot having a reduced tip wall thickness.

7. The turbine blade of claim 6, wherein the first recessed tip slot is positioned proximate to a row of ribs, and the second recessed tip slot is positioned proximate to another row of ribs.

8. The turbine blade of claim 7, further comprising a rib extending radially from an outer surface of the tip of the generally elongated blade and at a perimeter of the blade such that a pocket is formed within the rib on the outer surface of the tip wall of the generally elongated blade.

9. The turbine blade of claim 8, wherein the rib extending radially from an outer surface of the tip of the generally elongated blade is discontinuous such that a portion of the rib on a pressure side terminates upstream from the trailing edge while a portion of the rib on a suction side terminates at the trailing edge, thereby forming a pressure side slot in the pocket on the outer surface of the tip wall of the generally elongated blade.

10. The turbine blade of claim 1, further comprising a rib extending radially from an outer surface of the tip of the generally elongated blade and at a perimeter of the blade such that a pocket is formed within the rib on the outer surface of the tip wall of the generally elongated blade.

11. The turbine blade of claim 10, wherein the rib extending radially from an outer surface of the tip of the generally elongated blade is discontinuous such that a portion of the rib on a pressure side terminates upstream from the trailing edge while a portion of the rib on a suction side terminates at the trailing edge, thereby forming a pressure side slot in the pocket on the outer surface of the tip wall of the generally elongated blade.

12. A turbine blade, comprising:

a generally elongated blade having a leading edge, a trailing edge, a tip wall at a first end, a root coupled to the blade at an end generally opposite the first end for supporting the blade and for coupling the blade to a disc, and at least one cavity forming a cooling system in the blade;

at least one elongated tip cooling chamber forming a portion of the cooling system and at least partially defined by the tip wall proximate to the first end, wherein an inner surface of the tip wall includes a plurality of curved bumper protrusions extending from the inner surface radially inward toward the root;

wherein the cooling system includes a plurality of ribs generally aligned with the trailing edge and wherein the curved bumper protrusions extending radially inward from the inner surface of the tip wall are offset in a chordwise direction relative to the ribs; and wherein a throat section extending between a first forwardmost curved bumper protrusion and a second immediately adjacent downstream curved bumper protrusion is offset radially outward from an inner tip surface, thereby creating a first recessed tip slot having a reduced tip wall thickness.

13. The turbine blade of claim 12, wherein the first recessed tip slot is positioned proximate to a row of ribs.

14. The turbine blade of claim 12, further comprising a rib extending radially from an outer surface of the tip of the generally elongated blade and at a perimeter of the blade such that a pocket is formed within the rib on the outer surface of the tip wall of the generally elongated blade.

15. The turbine blade of claim 14, wherein the rib extending radially from an outer surface of the tip of the generally elongated blade is discontinuous such that a portion of the rib on a pressure side terminates upstream from the trailing edge while a portion of the rib on a suction side terminates at the trailing edge, thereby forming a pressure side slot in the pocket on the outer surface of the tip wall of the generally elongated blade.

16. The turbine blade of claim 12, wherein a throat section extending between the second curved bumper protrusion and a third immediately adjacent downstream curved bumper protrusion is offset radially outward from an inner tip surface, thereby creating a second recessed tip slot having a reduced tip wall thickness.

17. The turbine blade of claim 16, wherein the first recessed tip slot is positioned proximate to a row of ribs, and the second recessed tip slot is positioned proximate to another row of ribs.

18. A turbine blade, comprising:

a generally elongated blade having a leading edge, a trailing edge, a tip wall at a first end, a root coupled to the blade at an end generally opposite the first end for supporting the blade and for coupling the blade to a disc, and at least one cavity forming a cooling system in the blade;

at least one elongated tip cooling chamber forming a portion of the cooling system and at least partially defined by the tip wall proximate to the first end, wherein an inner surface of the tip wall includes a plurality of curved bumper protrusions extending from the inner surface radially inward toward the root;

wherein the cooling system includes a plurality of ribs generally aligned with the trailing edge and wherein the curved bumper protrusions extending radially inward from the inner surface of the tip wall are offset in a chordwise direction relative to the ribs;

wherein a throat section extending between a first forwardmost curved bumper protrusion and a second immediately adjacent downstream curved bumper protrusion is offset radially outward from an inner tip surface, thereby creating a first recessed tip slot having a reduced tip wall thickness;

wherein the first recessed tip slot is positioned proximate to a row of ribs;

a rib extending radially from an outer surface of the tip of the generally elongated blade and at a perimeter of the blade such that a pocket is formed within the rib on the outer surface of the tip wall of the generally elongated blade; and wherein the rib extending radially from an outer surface of the tip of the generally elongated blade is discontinuous such that a portion of the rib on a pressure side terminates upstream from the trailing edge while a portion of the rib on a suction side terminates at the trailing edge, thereby forming a pressure side slot in the pocket on the outer surface of the tip wall of the generally elongated blade.

19. The turbine blade of claim 18, wherein a throat section extending between the second curved bumper protrusion and a third immediately adjacent downstream curved bumper protrusion is offset radially outward from an inner tip surface, thereby creating a second recessed tip slot having a reduced tip wall thickness, and wherein the first recessed tip slot is positioned proximate to a row of ribs, and the second recessed tip slot is positioned proximate to another row of ribs.

* * * * *